US005249352A

United States Patent [19]

Landers

[11] Patent Number: 5,249,352

[45] Date of Patent: Oct. 5, 1993

[54] MACHINE AND METHOD FOR BUILDING PALLETS

[76] Inventor: John B. Landers, Rte. 7, Box 82-B, Sylacauga, Ala. 35150

[21] Appl. No.: 953,643

[22] Filed: Sep. 29, 1992

Related U.S. Application Data

[63] Continuation-in-part of Ser. No. 764,240, Sep. 23, 1991, abandoned.

[51] Int. Cl.[5] ..... B27M 3/00; B27F 7/09

[52] U.S. Cl. ..... 29/432; 29/281.5; 29/772; 29/798; 227/111; 227/154

[58] Field of Search ..... 29/281.1, 281.3, 281.5, 29/432, 565, 772, 798; 227/7, 8, 110, 111, 153, 154; 269/910; 100/913

[56] References Cited

U.S. PATENT DOCUMENTS

| | | | |
|---|---|---|---|
| 3,261,527 | 7/1966 | Sterner | 227/7 |
| 3,273,776 | 9/1966 | Bryson | 227/154 X |
| 3,557,439 | 1/1971 | Dykeman | 29/772 X |
| 4,378,900 | 4/1983 | Savermilch | 227/8 |
| 4,492,016 | 1/1985 | Smets et al. | 29/798 X |
| 4,757,605 | 7/1988 | Richardelli | 29/798 X |
| 4,793,540 | 12/1988 | Mangen et al. | 29/798 X |
| 4,824,004 | 4/1989 | Hanson | 29/798 X |
| 5,058,795 | 10/1991 | Tonus | 227/111 X |

*Primary Examiner*—Mark Rosenbaum
*Assistant Examiner*—S. Thomas Hughes
*Attorney, Agent, or Firm*—Wm. Randall May

[57] ABSTRACT

A semi-automatic, hand-operated, pallet building machine is disclosed wherein a gantry assembly is movably mounted to a pallet bed assembly. The gantry assembly is provided with an operator handle, a pair of roller assemblies, and a hinged, spring-retracted nailer carriage which contains a plurality of impact dischargable nail guns. The bed assembly is provided with adjustable slots and jigs for receiving, supporting and aligning the stringer boards and deckboards of a pallet. In operation, pallet stringer boards and top side deckboards are placed and properly positioned on the pallet bed assembly utilizing the adjustable slots and jigs. An operator moves the gantry assembly, using the operator handle, into position over the initial pallet deckboard whereupon the operator, again using the operator handle, causes the spring-retracted carriage of the gantry assembly to move downward until the nail guns come into contact with the deckboard thereby causing each nail gun to discharge one or more nails into the board. The operator then causes the gantry assembly to move to the next deckboard and repeats the securing operation for as many deckboards as are required for the top side of the pallet. Once the top side deckboards are secured, the partially completed pallet is turned over, the bottom side deckboards are then placed in proper position and the securing process is repeated for the bottom deckboards.

22 Claims, 6 Drawing Sheets

MACHINE AND METHOD FOR BUILDING PALLETS

CROSS-REFERENCE TO RELATED APPLICATIONS

This is a continuation-in-part of U.S. patent application Ser. No. 07/764,240 filed on Sep. 23, 1991, now abandoned.

BACKGROUND OF THE INVENTION

I. Field of the Invention

This invention relates generally to mechanized assemblage of wood frame or other frame-type structures and more specifically to a simplified method and apparatus for the quick and efficient assemblage of pallets.

II. Prior Art and Other Considerations

Pallets, particularly wooden pallets, have become an indispensible part of industrial and commercial shipping, handling and storage of goods. As a result, the demand for such structures has increased dramatically thereby creating a need for a simple and efficient means for manufacturing or producing pallets in order to meet the growing demand.

Machines and methods for assisting the construction or assemblage of wooden pallets have been used or attempted in the past and, as such, are not new to the art. However, in general, these machines, such as the ones disclosed in U.S. Pat. No. 3,273,776 to Bryson, U.S. Pat. No. 4,824,004 to Hanson, U.S. Pat. No. 3,557,439 to Dykeman, U.S. Pat. No. 3,261,527 to Sterner, and U.S. Pat. No. 4,492,016 to Smets, et al., are very complex and intricate in their design, construction and operation. Other machines, such as those disclosed in U.S. Pat. No. 5,058,795 to Tonus and U.S. Pat. No. 4,757,605 to Richardelli, while not as complex and intricate in their design and construction as those mentioned hereinabove, nevertheless utilize various clamping mechanisms, gripping mechanisms, sensing devices, belts, chains, motors, conveyors and other mechanisms in their construction and operation and, as a result, are very costly to build, operate and maintain.

The prior art machines are also generally quite large and bulky thereby occupying a generous amount of space for their physical presence and operation and are usually too heavy to relocate or move without tremendous effort or mechanized assistance.

It would be expedient, therefore, for the provision of a simplified method and apparatus which can be used to quickly and efficiently build and produce a large quantity of wooden pallets without the need for complex and intricate machinery, systems, parts and components and the resulting construction, operation, and maintenance costs associated with same.

SUMMARY OF THE INVENTION

In view of the foregoing, it is a primary object of this invention to provide a semi-automatic, hand-operated, method and apparatus for the quick and efficient assemblage of pallets, particularly wooden pallets.

An advantage of the present invention is the provision of a versatile, durable and very reliable method and apparatus for building pallets.

An advantage of the present invention is the provision of method and apparatus for building pallets which is relatively inexpensive to construct and operate.

Another advantage of the present invention is the provision of method and apparatus for building pallets which has relatively few moving parts and is easily maintained.

Another advantage of the present invention is the provision of method and apparatus for building pallets which does not require elaborate or intricate controls, switches, or sensors for proper operation.

A further advantage of the present invention is the provision of method and apparatus for building pallets which does not require the aid and expense of motors, hydraulics or electrical circuitry.

A further advantage of the present invention is the provision of method and apparatus for building pallets which is small and compact in its design, construction and operation.

According to an embodiment of the invention, a semi-automatic, hand-operated, pallet assemblage machine comprises a gantry assembly and a base assembly. The gantry assembly comprises a frame which is moveably mounted to the base assembly and has a plurality of nail guns adjustably mounted to a hinged, spring-retracted section of the gantry assembly frame. Movement of the gantry assembly is actuated by the engagement of an operator handle. Transverse movement of the gantry assembly is provided by a roller assembly which allows for the free movement of the gantry with respect to the base assembly. Vertical movement of the hinged, spring-retracted section of the gantry assembly is also provided by engagement of the operator handle in a downward motion which allows for the automatic discharge of the nail guns upon contact with a workpiece such as the deckboards of a wooden pallet.

The base assembly comprises a frame and a bed having a plurality of adjustable slots and jigs for supporting and arranging the stringer boards and deckboards of a wooden pallet. In operation, pallet stringer boards and top side deckboards are placed and properly positioned on the bed of the base assembly utilizing the adjustable slots and jigs. An operator moves the gantry assembly, using the operator handle, into position over the initial deckboard whereupon the operator, again using the operator handle, causes the spring retracted frame of the gantry, which houses the nail guns, to move downward until the nail guns come into contact with the deckboard thereby causing each nail gun to discharge one or more nails into the board. The operator then causes the gantry assembly to move to the next deckboard and repeats the securing operation for as many deckboards as are required for the top side of the pallet. Once the top side deckboards are secured, the partially completed pallet is turned over, the bottom side deckboards are then placed in proper position and the securing process is repeated for the bottom deckboards of the pallet. The finished pallet is then removed from the bed of the base assembly and stored and the process is repeated for the next pallet to be built.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
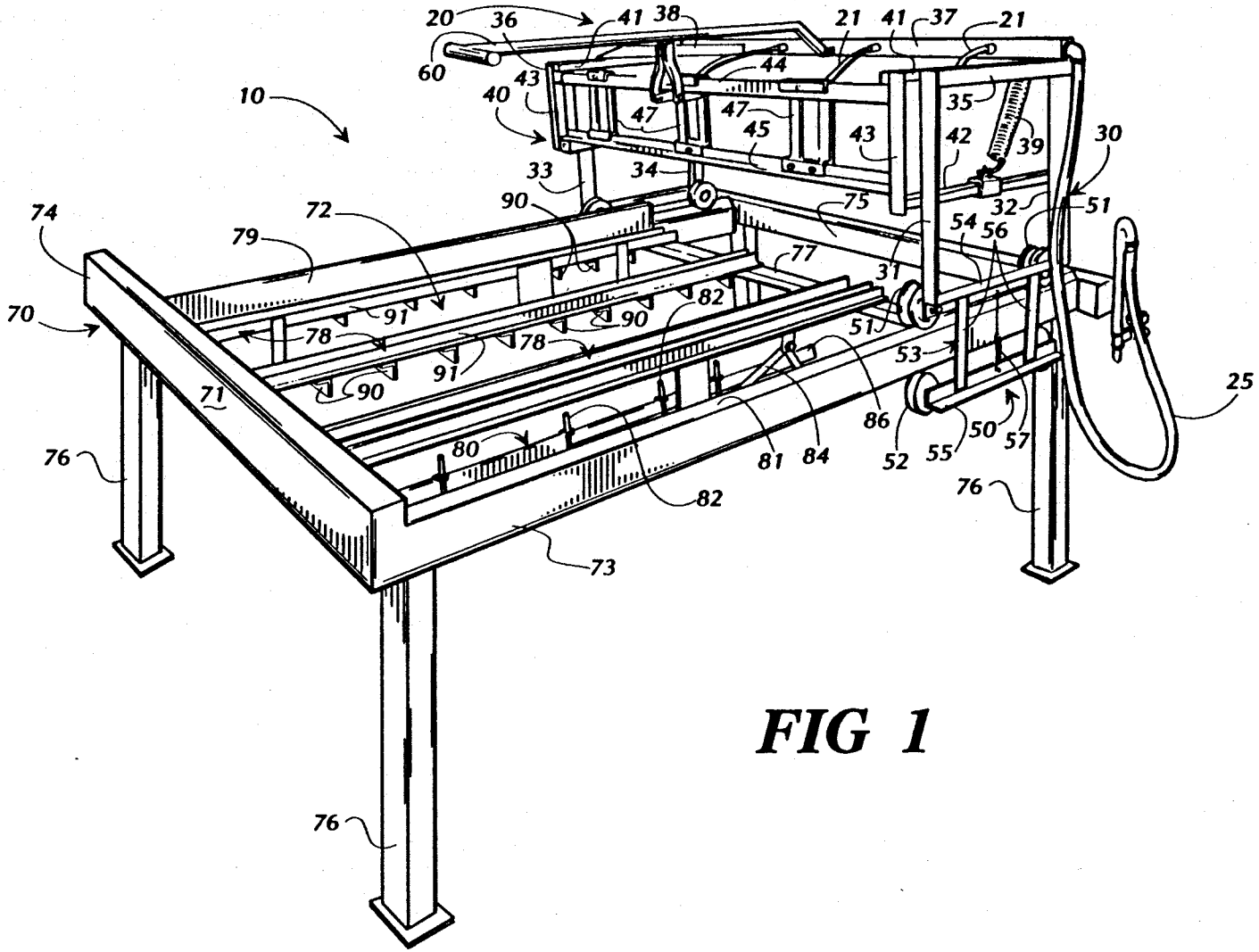
FIG. 1 is a perspective view of an embodiment of the invention.

FIG. 1 shows a semi-automatic, hand-operated, pallet building machine 10 according to an embodiment of the invention. The pallet building machine 10 comprises a gantry assembly 20 and a base assembly 70 upon which the gantry assembly 20 is moveably mounted.

The gantry assembly 20 comprises a frame 30, including a hinged, spring-retracted, nailer section 40; a pair of roller assemblies 50, one for each side of the gantry assembly frame 30; and, an operator handle 60.

The gantry frame 30 is comprised of four vertical support members 31, 32, 33 and 34; two horizontal support members 35 and 36; a tubular crosspiece member 37; and a pair of angle braces 38. Vertical support members 31, 32, 33, and 34 form the "sides" of gantry frame 30 with vertical support members 31 and 32 forming the right side corners and vertical support members 33 and 34 forming the left side corners of gantry frame 30. The horizontal support members 35 and 36 are rigidly attached to the upper ends of vertical support members 31, 32, 33 and 34 with horizontal support members 35 attaching to and between, right side support members 31 and 32 and horizontal support member 36 attaching to and between, left side vertical support members 33 and 34. The tubular crosspiece member 37 extends horizontally between, and rests upon, the upper ends of vertical support members 32 and 34 and is rigidly attached thereto. Said tubular crosspiece member 37 is closed, in an airtight manner, at one end with the other end being attached to a pneumatic piping system 25. The pneumatically active tubular crosspiece member 37 is used to provide pnuematic power to the nailer section 40. The lower ends of each pair of vertical support members 31, 32 and 33, 34 are rigidly attached to one of the roller assemblies 50 located at either side of the gantry assembly frame 30. Angle braces 38 are situated at the top rear corners of the gantry frame 30 for stability, with each brace 38 being rigidly and securely attached to and between, at an approximate 45° angle, the tubular crosspiece member 37 and one of the horizontal support members 35, 36. (The angle braces 38 also act as a stop for the spring-retracted nailer section 40.)

Figure 2:
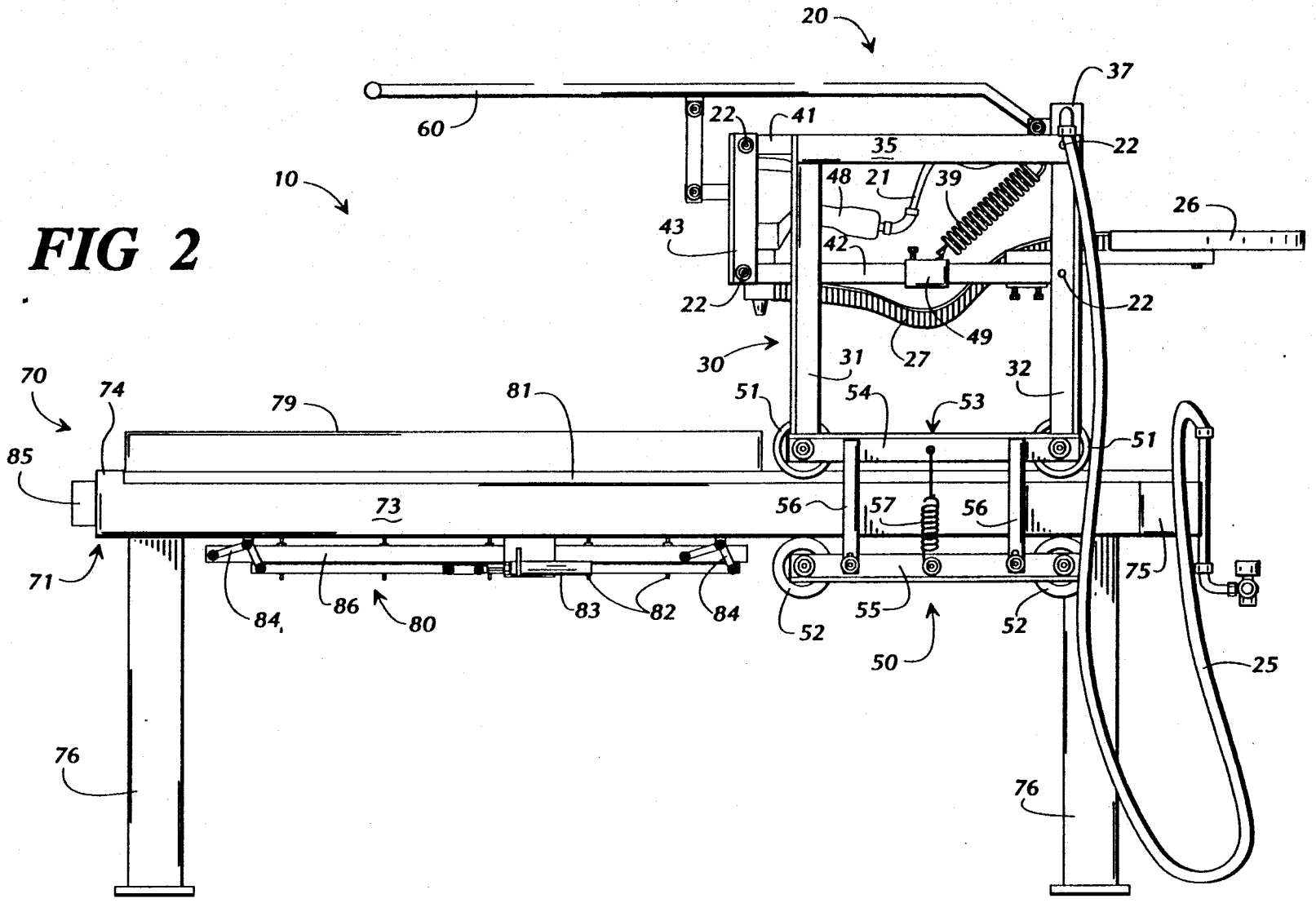
FIG. 2 is a side view of the embodiment of FIG. 1.
Figure 4:
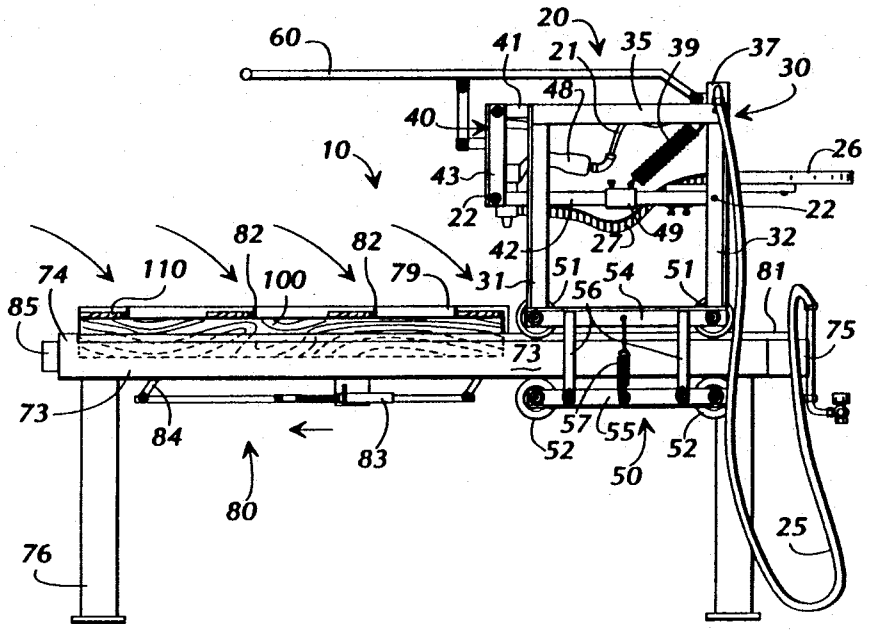
FIG. 4 is a side view of the embodiment of FIG. 1 shown with stringer boards and top side deckboards in place on the base assembly.
Figure 3:
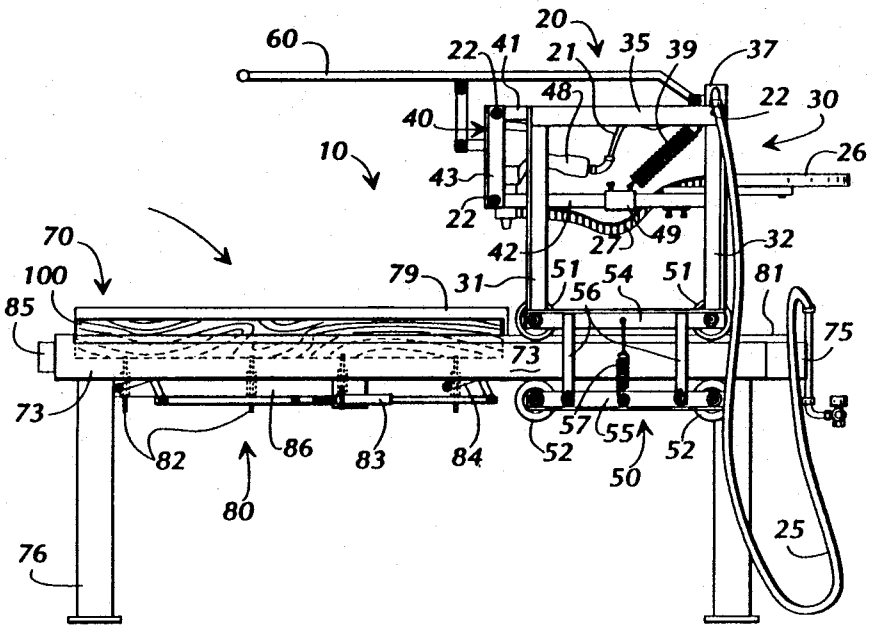
FIG. 3 is a side view of the embodiment of FIG. 1 shown with stringer boards in place on the base assembly.
Figure 5:
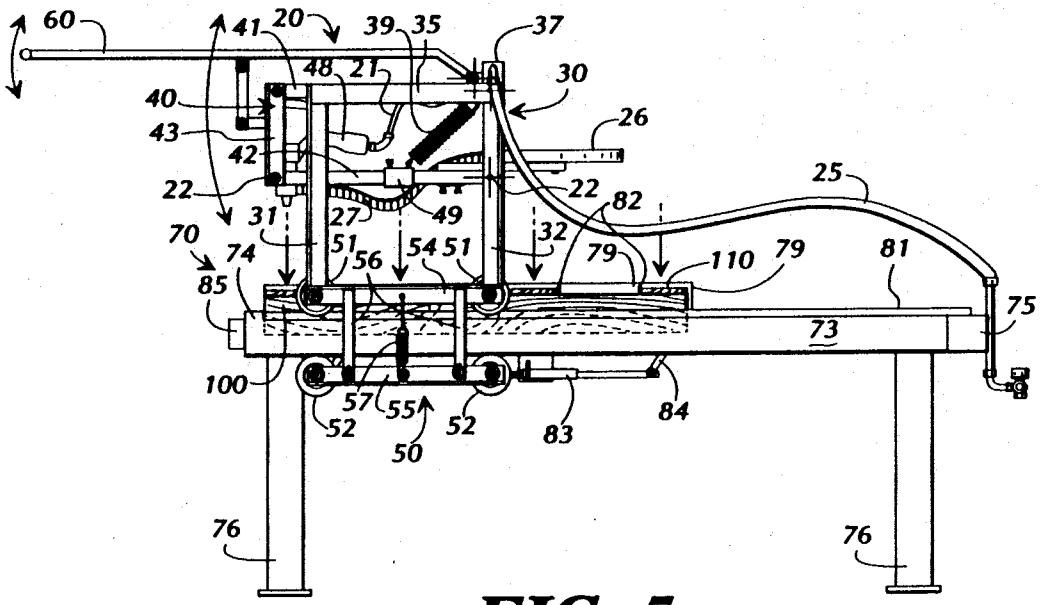
FIG. 5 is a side view of the embodiment of FIG. 1 illustrating the movement of the gantry assembly as it is being used to secure the top side deckboards to the pallet stringer boards.
Figure 6:
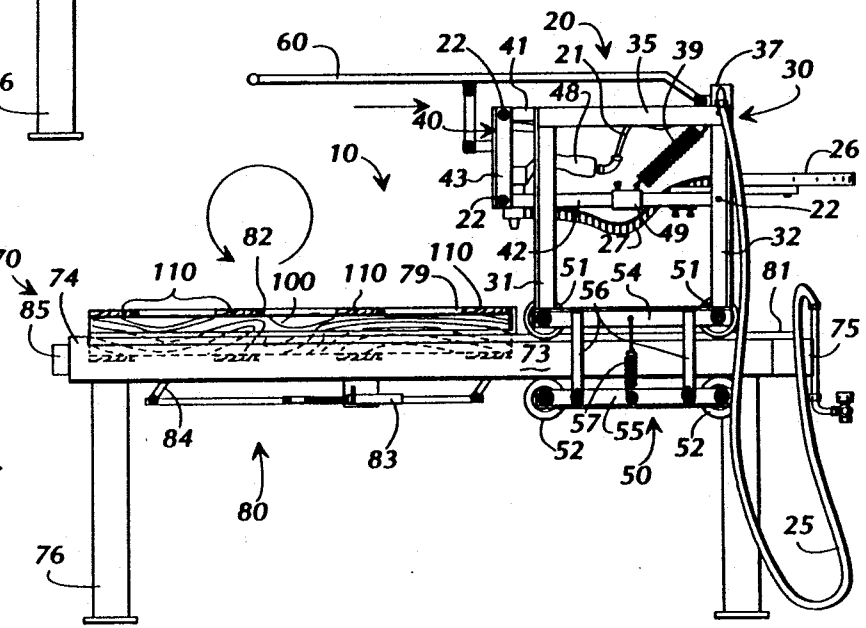
FIG. 6 is a side view of the embodiment of FIG. 1 showing the gantry assembly being returned to its initial position with the partially constructed pallet being rotated and showing the bottom side deckboards in place on the base assembly.
Figure 5A:
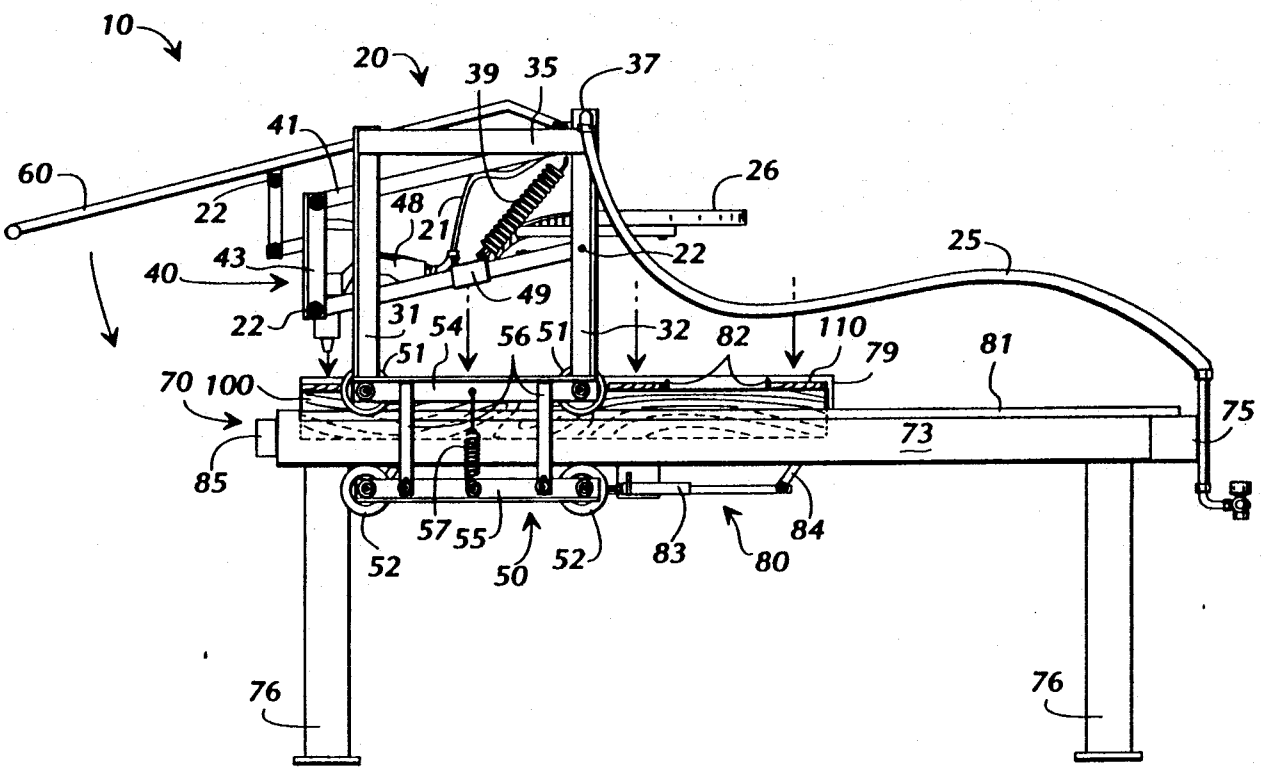
FIG. 5A is a side view of the embodiment of FIG. 1 showing the hinged, spring-retracted section of the gantry assembly engaging a pallet deckboard.
Figure 7:
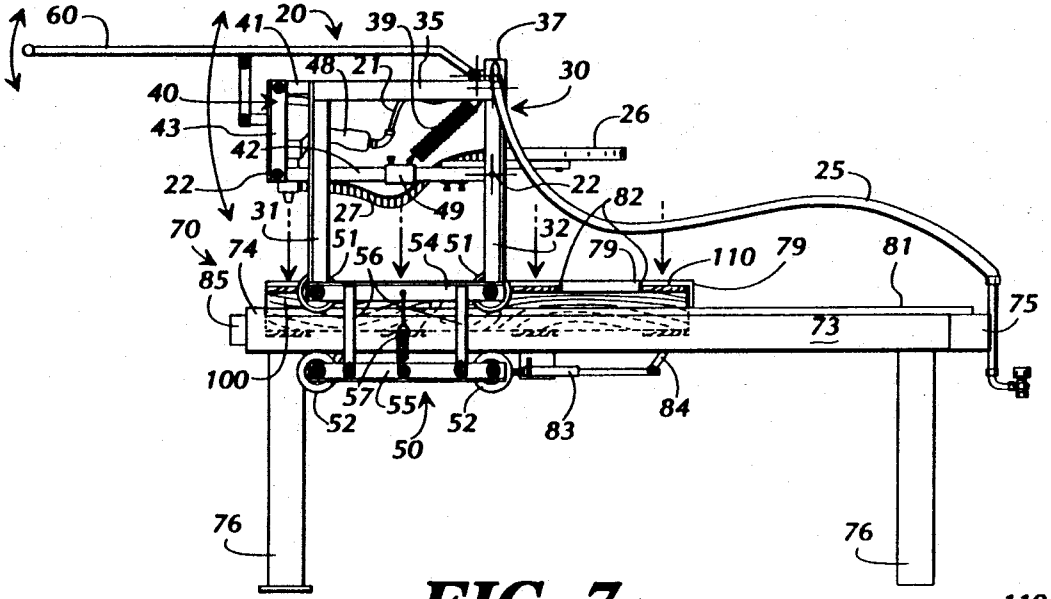
FIG. 7 is a side view of the embodiment of FIG. 1 illustrating the movement of the gantry assembly as it is used to secure the bottom side deckboards to the pallet stringer boards.
Figure 8:
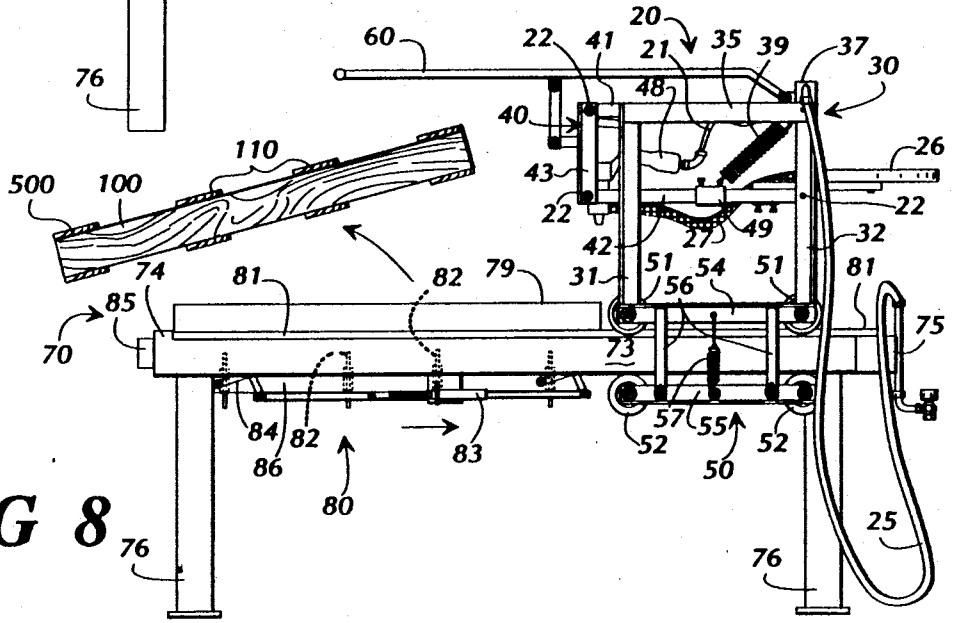
FIG. 8 is a side view of the embodiment of FIG. 1 showing the gantry assembly being returned to its initial position and the fully assembled pallet being removed from the bed assembly.

The spring-retracted nailer section 40 is generally rectangular in shape and is moveably attached to the gantry frame 30 through the use of axle hinges 22 located on vertical support members 32 and 34 at the rear of the gantry frame 30. This hinged attachment of nailer section 40 allows the nailer section 40 to be moved in a slightly arcuate, but essentially linear and vertical manner with respect to the gantry frame 30 and the base assembly 70. Said nailer section 40 is comprised of a pair of upper and lower side arms 41 and 42 respectively; two vertical front support members 43; and, a plurality of adjustable nail gun brackets 47. Referring now specifically to FIG. 2, each pair of upper and lower side arms 41 and 42 is hingeably attached, at one end, to the ganrty frame 30 at axle hinges 22 located on vertical support members 32 and 34. The other end of each pair of upper and lower side arms 41 and 42 is hingeably attached to one of the vertical front support members 43 using axle hinges 22. The upper and lower transverse support members 44 and 45, respectively, are each rigidly attached to, and extend horizontally between, the two vertical front support members 43. Nail gun brackets 47 are adjustably attached, at predetermined locations, between the upper and lower transverse support members 44 and 45 and allow for the attachment of a predetermined number of transversely spaced, vertically disposed, pneumatically powered nail guns 48 which fire upon impact. Pneumatic power is provided to the nail guns 48 through a set of pneumatic hoses 21 attached to the tubular crosspiece member 37 of gantry frame 30. Depending upon the requirements of the particular nail guns 48 used with the invention, an optional nail feed platform 26 may be attached to the gantry frame 30 for the continuous supply of nails 27 to said nail guns 48.

A pair of gantry springs 39 are attached, at one end, to the gantry frame 30 and at the other end to the gantry nailer section 40 and provide for the automatic return of the nailer section 40 to the top of gantry frame 30 when said nailer section 40 is caused to move in a downward direction and then released. The upper end of each gantry spring 39 is attached to the tubular crosspiece member 37 of gantry frame 30. The lower end of each gantry spring 39 is adjustably attached to one of the lower side arms 42 using a sleeve 49.

Each roller assembly 50 is comprised of a pair of upper rollers 51; a pair of lower rollers 52; and, a roller carriage 53. Said roller carriage 53 has an upper support 54 and a lower support 55 and two adjustable clamp supports 56. The upper rollers 51 are grooved and are transversely mounted at the ends of the upper support 54. The lower rollers 52 are round and are transversely mounted at the ends of the lower support 55. The upper support 54 also serves as a base for the gantry assembly frame 30 with right side vertical support members 31 and 32 being rigidly and securely attached to the right side roller assembly 50 and the left side vertical support members 33 and 34 being rigidly and securely attached to the left side roller assembly 50. The adjustable clamp supports 56 extend vertically between the upper support 54 and the lower support 55 and are adjustably attached thereto. A roller assembly tension spring 57 is attached to the upper support 54 and the lower support 55 and is situated between clamp supports 56.

The operator handle 60 comprises a "T" shaped bar which is hingeably and centrally attached to the tubular crosspiece member 37 of the gantry frame 30. Said handle 60 is also hingeably and centrally attached to the upper transverse support member 44 of the spring-retracted nailer section 40. Attachment of the operator handle 60 in this manner provides for the essentially vertical movement of the hinged, spring-retracted nailer section 40 of the gantry assembly 20 as the operator handle 60 is moved in a downward direction. The gantry springs 39 provide for the automatic return of the nailer section 40 to the top of the gantry frame 30 once the operator handle 60 has been moved in a downward direction and released.

Transverse movement of the entire gantry assembly 20 is provided by the roller assemblies 50 which are moveably mounted to either side of the base assembly 70.

The base assembly 70 is comprised of a frame 71 and a bed 72. The base assembly frame 71 is rectangular in shape comprising two side rails 73; a front rail 74; a back rail 75 and four legs 76. The base assembly bed 72 is comprised of one or more cross-slats 77; a plurality of parallel adjustable slots 78 for support and placement of pallet stringer boards 100; at least one abuttment flange 79 for lateral alignment of pallet deckboards 110 and two pneumatically powered adjustable jig assemblies 80 for transverse alignment of pallet deckboards 110.

The side rails 73 of base frame 71 are each provided with an inverted "V" shaped track 81 to which are mounted the roller assemblies 50 of the gantry assembly 20. Said track 81 allows the grooved upper rollers 51 of each roller assembly 50 to freely move the length of the base frame 71 without lateral displacement. The lower rollers 52 of the roller assemblies 50 are in frictional contact with the bottom side of the side rails 73 and are allowed to roll freely thereon. The front rail 74 and the back rail 75 of frame 71 extend slightly above the side rails 73 and act as front and rear roller stops for the roller assemblies 50 of gantry assembly 20.

The cross-slats 77 of bed 72 are rigidly and securely attached, at either end, to the side rails 73 of frame 71 and serve as the front and rear supports for the adjustable slots 78. Each slot 78 is comprised of a pair of "L" shaped braces 91 which are adjustably attached to cross-slats 77 and serve as lateral support for pallet stringer boards 100 during the building operation. Said slots 78 have a plurality of support bars 90 which are each rigidly and perpendicularly attached to the bottom side of one of said "L" shaped braces 91 in each slot 78. Said support bars 90 serve as lower support for pallet stringer boards 100 during the building operation. An abuttment flange 79 is attached to the inside edge of at least one of the side rails 73 of frame 71. Said flange 79 is comprised of a rigid metal plate which is rectangular in shape and extends above the side rails 73 of frame 71 and has a length substantially equal to that of the adjustable slots 78. Said abuttment flange 79 is used during the pallet building operation for lateral alignment of the edges of the pallet deckboards 110 as said boards 110 are placed on the base assembly bed 72. Transverse alignment of the pallet deckboards 110 is provided by two or more adjustable jig assemblies 80. Each jig assembly 80 comprises a predetermined number of jigs 82 which are adjustably attached to a retractable jig bar 86. Said jig bar 86 is operatively attached to a pneumatically powered piston 83 using a pair of levers 84. Extension of piston 83 causes the jig bar 86 to move in an upward direction with respect to the base assembly bed 72 thereby causing the adjustable jigs 82 to extend above the base assembly frame 71 to a predetermined height. Said jigs 82, once extended, are used to transversely align and properly position pallet deckboards 110 during a pallet building operation. A pneumatic switch 85 is provided for engagement of said pneumatic piston 83 and is attached near the front of the base assembly frame 71.

In operation, a predetermined number of pallet stringer boards 100 and top side deckboards 110 are placed and properly positioned and aligned on the base assembly bed 72 utilizing the adjustable slots 78 and jig assemblies 80. An operator, utilizing the operator handle 60, then causes the gantry assembly 20 to move into position over the initial deckboard 110 whereupon the operator, again using the operator handle 60, causes the spring-retracted nailer section 40 of the gantry assembly 20 to move in a downward direction. Said downward motion is continued until the pneumatic nail guns 48 of said nailer section 40 come into contact with said deckboard 110 which causes the discharge of one or more nails 27, at the discretion of the operator, into said deckboard 110 thereby securing said deckboard 110 to the pallet stringer boards 100. The operator then causes the gantry assembly 20 to move to the next deckboard 110 and the securing operation is repeated for an many deckboards 110 as are required for the top side of the pallet 500. Once the top side deckboards 110 are secured, the partially completed pallet 500 is turned over, the bottom side deckboards 110 are then properly positioned and aligned, and the securing process is repeated for the bottom deckboards 110 of the pallet 500. The finished pallet 500 is then removed from the bed 72 of the base assembly 70 and the process is repeated for the next pallet 500 to be built.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. A semi-automatic, hand-operated, apparatus for assemblage of pallets comprising:
- a gantry assembly comprising:
  - a frame having a vertically moveable section;
  - a pair of roller assemblies operatively attached to said frame for transverse movement of said gantry frame;
  - a plurality of deckboard securing means attached to said vertically moveable section of said gantry frame; and,
  - an operator handle for actuating transverse movement of said gantry assembly and for actuation of said vertical movement of said vertically moveable section of said gantry frame;
- a base assembly comprising:
  - a frame having a front rail, a back rail, two side rails and legs, with said gantry assembly being moveably mounted to said frame;
  - a bed having a plurality of adjustable slots for receiving pallet stringer boards and one or more jig assemblies for placement and alignment of pallet deckboards over and across said pallet stringer boards.

2. The apparatus of claim 1, wherein said gantry assembly frame comprises:

a plurality of vertical support members;

two horizontal support members;

a tubular crosspiece member;

a pair of angle braces; and, a vertically moveable section.

3. The apparatus of claim 1, wherein said vertically moveable section of said gantry frame is hingeably attached to said gantry assembly frame.

4. The apparatus of claim 1, wherein said vertically moveable section of said gantry frame is spring-retracted.

5. The apparatus of claim 1, wherein said plurality of deckboard securing means are adjustably attached to said vertically moveable section of said gantry frame.

6. The apparatus of claim 1, wherein said gantry assembly further comprises a feeder plateform for supplying said plurality of deckboard securing means with securing devices.

7. The apparatus of claim 1, wherein said roller assemblies are mounted on either side of said base assembly frame and comprise:

a roller carriage;

a pair of upper rollers; and, a pair of lower rollers.

8. The apparatus of claim 7, wherein said upper rollers are grooved.

9. The apparatus of claim 1, wherein said side rails of said base assembly frame have a track means mounted thereon for receiving said pair of gantry assembly roller assemblies.

10. The apparatus of claim 1, wherein said operator handle comprises a "T" shaped bar which is hingeably attached to said gantry assembly frame and to said vertically moveable section of said gantry frame.

11. The apparatus of claim 1, wherein said plurality of deckboard securing means are pneumatically powered and receive said pneumatic power through said gantry assembly frame.

12. The apparatus of claim 1, wherein said jig assemblies of said base assembly bed comprise a plurality of adjustable jigs.

13. The apparatus of claim 12, wherein said adjustable jigs are pneumatically powered.

14. The apparatus of claim 1, wherein said base assembly frame further comprises at least one abuttment flange for lateral alignment of pallet deckboards.

15. A semi-automatic, hand-operated, apparatus for assemblage of pallets comprising:

a gantry assembly comprising:

a frame for moveably supporting a hinged, spring-retracted carriage, said carriage having a plurality of deckboard securing means attached to said carriage;

a pair of roller assemblies operatively attached to said gantry assembly frame for transverse movement of said gantry assembly;

an operator handle for actuating transverse movement of said gantry assembly and for actuation of said hinged, spring-retracted carriage;

a base assembly comprising:

a frame having a front rail, a back rail, two side rails and legs, with said roller assemblies of said gantry assembly being transversely mounted to said side rails of said frame;

a bed having a plurality of adjustable slots for receiving pallet stringer boards and one or more jig assemblies for placement and alignment of pallet deckboards over and across said pallet stringer boards.

16. A method of assembling pallets comprising:

placing a plurality of pallet stringer boards into adjustable slots of a pallet assembly bed;

causing one or more jig assemblies of said pallet assembly bed to extend in an upward direction for transverse alignment and positioning of said plurality of stringer boards onto said pallet assembly bed;

using said jig assemblies and an abuttment flange to position and align a plurality of top side pallet deckboards perpendicularly over said stringer boards;

engaging an operator handle to move a gantry assembly, which is operably attached to said pallet assembly bed, into position over a first deckboard;

using said operator handle to vertically move a deckboard securing carriage assembly, which is operatively attached to said gantry assembly, so as to bring said deckboard securing carriage into contact with said first deckboard;

securing said first deckboard to said stringer boards by discharging one or more securing means into said first deckboard;

moving said deckboard securing carriage to a next deckboard and repeating said securing operation for as many deckboards as are required for the top side of said pallet;

inverting a partially completed pallet on said pallet assembly bed;

placing and aligning a plurality of bottom side deckboards over the bottom side of said stringer boards;

repeating the deckboard securing operation for each of the bottom side deckboards thereby forming a finished product; and, removing the finished pallet from said pallet assembly bed.

17. The method of claim 16, wherein said jig assemblies comprise a plurality of adjustable jigs operatively mounted to said pallet assembly bed.

18. The method of claim 16, wherein said jig assemblies are pneumatically powered.

19. The method of claim 16, wherein said deckboard securing carriage is spring-retracted and is hingeably attached to said gantry assembly.

20. The method of claim 16, wherein said securing means are nails.

21. The method of claim 16, wherein said deckboard securing carriage comprises a plurality of nail guns.

22. The method of claim 21, wherein said nail guns are pneumatically powered.

* * * * *